US011092918B1

(12) United States Patent
Hara et al.

(10) Patent No.: US 11,092,918 B1
(45) Date of Patent: Aug. 17, 2021

(54) HEATING DEVICE AND IMAGE FORMING APPARATUS INCLUDING HEAT PIPE HAVING FLAT OUTER SURFACE

(71) Applicant: FUJIFILM Business Innovation Corp., Tokyo (JP)

(72) Inventors: Toko Hara, Kanagawa (JP); Toru Inoue, Kanagawa (JP); Kazuyoshi Itoh, Kanagawa (JP); Toshiyuki Miyata, Kanagawa (JP); Kiyoshi Koyanagi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/917,916

(22) Filed: Jul. 1, 2020

(30) Foreign Application Priority Data

Mar. 27, 2020 (JP) ..... JP2020-058591

(51) Int. Cl.
*G03G 15/20* (2006.01)

(52) U.S. Cl.
CPC . *G03G 15/2053* (2013.01); *G03G 2215/2019* (2013.01)

(58) Field of Classification Search
USPC ..... 399/338
See application file for complete search history.

(56) References Cited

U.S. PATENT DOCUMENTS

| | | | | |
|---|---|---|---|---|
| 6,339,211 | B1 * | 1/2002 | Foote | G03G 15/2064 118/60 |
| 6,690,907 | B2 * | 2/2004 | Lee | G03G 15/2053 219/216 |
| 7,327,978 | B2 * | 2/2008 | de Jong | G03G 15/2053 399/320 |
| 2004/0042826 | A1 * | 3/2004 | Cho | G03G 15/2064 399/328 |
| 2011/0085832 | A1 * | 4/2011 | Hasegawa | G03G 15/2032 399/329 |
| 2017/0255137 | A1 * | 9/2017 | Hayashi | G03G 15/652 |

FOREIGN PATENT DOCUMENTS

| | | | | |
|---|---|---|---|---|
| JP | H05289555 | | 11/1993 | |
| JP | 08137305 | A * | 5/1996 | G03G 15/2053 |
| JP | 3124364 | | 1/2001 | |
| JP | 2007199151 | | 8/2007 | |
| JP | 2013-142834 | | 7/2013 | |

* cited by examiner

*Primary Examiner* — Q Grainger
(74) *Attorney, Agent, or Firm* — JCIPRNET

(57) ABSTRACT

A heating device includes a rotating unit, a transport belt, a heater, and a heat pipe. The rotating unit rotates. The transport belt rotates together with the rotating unit while nipping a heated member together with the rotating unit so as to transport the heated member. The heater has a contact surface in contact with an inner peripheral surface of the transport belt and a flat non-contact surface not in contact with the inner peripheral surface, and generates heat so as to heat the heated member via the transport belt. The heat pipe has a flat outer surface in contact with the non-contact surface of the heater and an interior having a cross-sectionally-circular space filled with a working fluid, and transfers heat in a belt width direction of the transport belt in accordance with a function of the working fluid.

19 Claims, 6 Drawing Sheets

HEATING DEVICE AND IMAGE FORMING APPARATUS INCLUDING HEAT PIPE HAVING FLAT OUTER SURFACE

CROSS-REFERENCE TO RELATED APPLICATIONS

This application is based on and claims priority under 35 USC 119 from Japanese Patent Application No. 2020-058591 filed Mar. 27, 2020.

BACKGROUND

(i) Technical Field

The present disclosure relates to heating devices and image forming apparatuses.

(ii) Related Art

Japanese Unexamined Patent Application Publication No. 2013-142834 discloses an image forming apparatus that causes a heated member to pass through a fixation nip formed by a heater, a film member rotatably disposed in pressure contact with the heater, and a presser disposed in pressure contact with the heater with the film member interposed therebetween. In this image forming apparatus, the heater is a plate-like heat pipe, a heating element is printed on the fixation-nip-facing surface of a heat pipe substrate with an insulation layer interposed therebetween, and the outermost surface is coated with the insulation layer.

SUMMARY

In a conceivable configuration that uses a heater to heat a heated member, transported by a rotating unit and a transport belt, via the transport belt, a heat pipe is used to transfer heat from a high temperature section to a low temperature section of the heater (referred to as "configuration A" hereinafter).

In the aforementioned configuration A, if the heat pipe used is cylindrical, the contact area with the heater tends to be small since the outer peripheral surface of the heat pipe is circular in cross section.

Aspects of non-limiting embodiments of the present disclosure relate to ensuring a sufficient contact area with a heater, as compared with a configuration that uses a cylindrical heat pipe.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a heating device including a rotating unit, a transport belt, a heater, and a heat pipe. The rotating unit rotates. The transport belt rotates together with the rotating unit while nipping a heated member together with the rotating unit so as to transport the heated member. The heater has a contact surface in contact with an inner peripheral surface of the transport belt and a flat non-contact surface not in contact with the inner peripheral surface, and generates heat so as to heat the heated member via the transport belt. The heat pipe has a flat outer surface in contact with the non-contact surface of the heater and an interior having a cross-sectionally-circular space filled with a working fluid, and transfers heat in a belt width direction of the transport belt in accordance with a function of the working fluid.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will be described below with reference to the drawings.

Image Forming Apparatus 10

Figure 1:
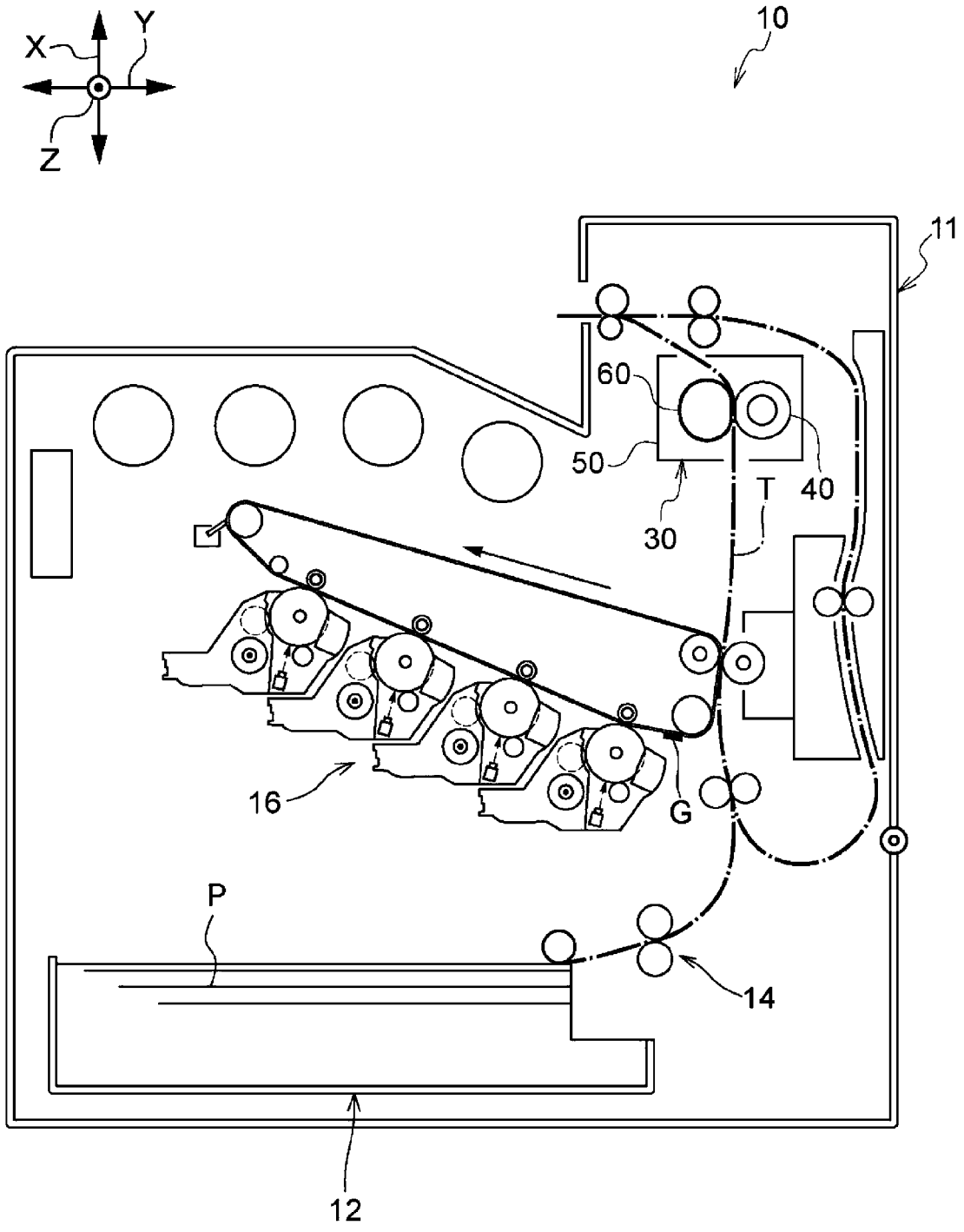
FIG. 1 schematically illustrates the configuration of an image forming apparatus according to this exemplary embodiment.

The configuration of an image forming apparatus 10 according to an exemplary embodiment will now be described. FIG. 1 schematically illustrates the configuration of the image forming apparatus 10 according to this exemplary embodiment. In the following description, the height direction, the depth direction, and the left-right direction of the image forming apparatus 10 will be referred to as, "apparatus height direction", "apparatus depth direction", and "apparatus width direction", respectively. The apparatus height direction, the apparatus depth direction, and the apparatus width direction are orthogonal to one another. In the drawings, the apparatus height direction is indicated by an arrow X, the apparatus depth direction is indicated by an arrow Z, and the apparatus width direction is indicated by an arrow Y. Because these directions are defined for the sake of convenience, the apparatus configuration is not to be limited to these directions.

As shown in FIG. 1, the image forming apparatus 10 includes an apparatus body 11, a container 12 that contains at least one sheet P, a transport unit 14 that transports the sheet P, an image forming unit 16 that forms a toner image G onto the sheet P, and a fixing device 30.

The sheet P is an example of a recording medium as well as a heated member. The toner image G is an example of an image. The image forming unit 16 is an example of an image forming unit. The transport unit 14 transports the sheet P upward from the container 12 in the apparatus height direction along a transport path T. For example, the image forming unit 16 performs a known electrophotographic process including an electrostatic charging step, an exposure step, a developing step, and a transfer step by using a single-color toner or multicolor toners, so as to form the toner image G onto the sheet P transported by the transport unit 14.

Fixing Device 30

Figure 2:
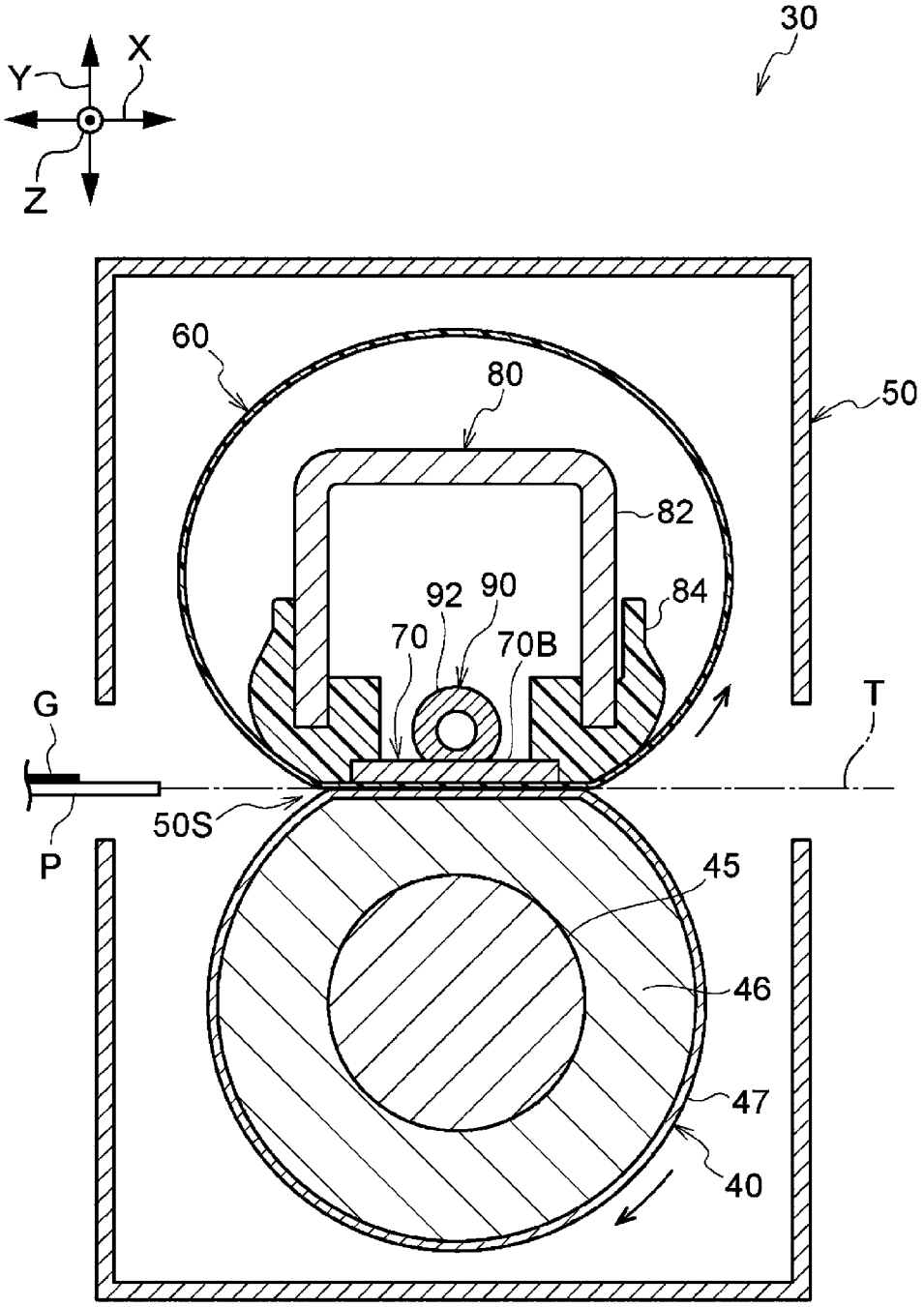
FIG. 2 schematically illustrates the configuration of a fixing device according to this exemplary embodiment.

The fixing device 30 shown in FIG. 1 is an example of a heating device. The fixing device 30 heats the toner image G formed on the sheet P by the image forming unit 16, so as to fix the toner image G onto the sheet P. In detail, as shown in FIG. 1, the fixing device 30 has a device body 50, a pressing roller 40, and a heating belt 60. Furthermore, as shown in FIG. 2, the fixing device 30 has a heater 70, a supporter 80, and a heat pipe 90. These components of the fixing device 30 will be described below in detail.

Device Body 50

The device body 50 shown in FIG. 1 is detachable from the apparatus body 11 of the image forming apparatus 10. Accordingly, the entire fixing device 30 is detachable from the apparatus body 11 of the image forming apparatus 10. The device body 50 has a support frame (not shown) that supports the individual components of the fixing device 30.

Pressing Roller 40 and Heating Belt 60

The pressing roller 40 is an example of a rotating unit. The heating belt 60 is an example of a transport belt.

The pressing roller 40 and the heating belt 60 are disposed facing each other.

The heating belt 60 is annular, specifically, endless. For example, the heating belt 60 is a polyimide-resin member with a fluorine-coated outer peripheral surface. The opposite ends of the heating belt 60 in the belt width direction are rotatably supported by a support member (not shown).

The belt width direction intersects with (specifically, orthogonal to) a rotational direction in which the heating belt 60 rotates, and is parallel to the Z direction. This belt width direction may also be regarded as a direction parallel to a rotational axis (also referred to as "axial direction" hereinafter) of the pressing roller 40.

The pressing roller 40 has a shaft 45 whose axial direction is aligned with the apparatus depth direction (i.e., the Z direction), an elastic layer 46 provided around the outer periphery of the shaft 45, and a separation layer 47 provided around the outer periphery of the elastic layer 46. The shaft 45 is pressed toward the heater 70 by a presser including a spring (not shown). Accordingly, a contact region 50S (i.e., a fixation nip) where the heating belt 60 and the pressing roller 40 are in contact with each other is formed. In other words, the contact region 50S is formed between the heating belt 60 and the pressing roller 40.

Furthermore, with regard to the pressing roller 40, the shaft 45 is supported by a bearing (not shown) and is rotated by a driver (not shown). On the other hand, the heating belt 60 rotates by being driven by the pressing roller 40. Accordingly, the heating belt 60 rotates together with the pressing roller 40 while nipping the sheet P together with the pressing roller 40, thereby transporting the sheet P. This sheet P is pressed by the pressing roller 40 and the heating belt 60 and is also heated by the heater 70, so that the toner image G formed on the sheet P is fixed thereon.

Heater 70

As shown in FIG. 2, the heater 70 is disposed inside the heating belt 60 and is supported by the supporter 80 to be described later. The heater 70 has a planar shape (i.e., a tabular shape) whose thickness direction is aligned with the apparatus width direction (i.e., the Y direction), and extends longitudinally in the belt width direction (i.e., the Z direction) of the heating belt 60.

Figure 3:
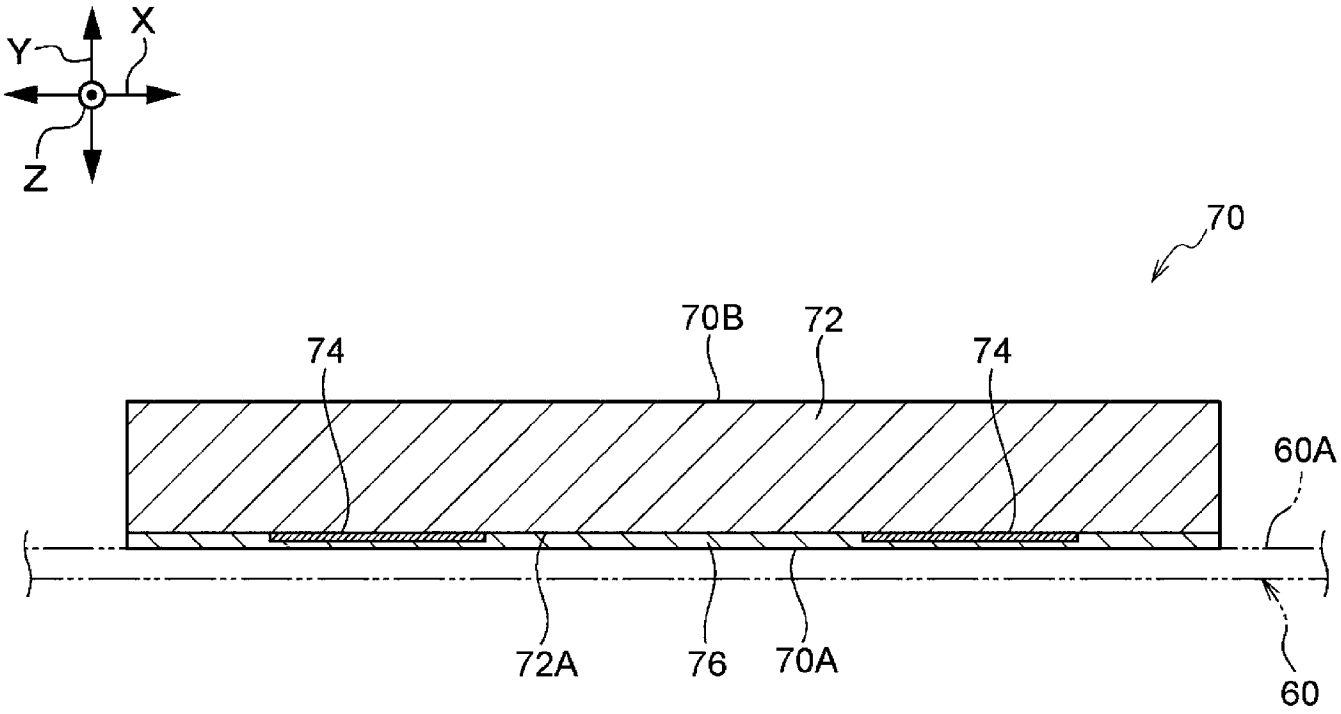
FIG. 3 schematically illustrates the configuration of a heater according to this exemplary embodiment.

As shown in FIG. 3, the heater 70 has a contact surface 70A in contact with an inner peripheral surface 60A of the heating belt 60, and also has a flat non-contact surface 70B not in contact with the inner peripheral surface 60A. The non-contact surface 70B is disposed at the opposite side from the heating belt 60 relative to the contact surface 70A. In other words, the non-contact surface 70B is opposed to the contact surface 70A. Moreover, the non-contact surface 70B is disposed parallel to the contact surface 70A. Specifically, the distance between the non-contact surface 70B and the contact surface 70A is fixed in the apparatus height direction (i.e., the X direction).

Furthermore, as shown in FIG. 3, the heater 70 has a substrate 72, a resistor 74, and a protection layer 76. The substrate 72 is formed of a rectangular plate that is long in the apparatus depth direction (i.e., the Z direction) and short in the apparatus height direction (i.e., the X direction). The substrate 72 is formed of, for example, an alumina molded body. The thickness of the substrate 72 in the apparatus width direction (i.e., the Y direction) is, for example, about 1 mm.

The resistor 74 is provided on a surface 72A at the pressing roller 40 side of the substrate 72. The opposite ends of the resistor 74 in the apparatus depth direction are provided with electrodes (not shown). The electrodes are connected to a power supply (not shown). Electricity is applied to the resistor 74 from the power supply, so that Joule heat occurs in accordance with an internal resistance of the resistor 74, whereby the resistor 74 generates heat.

The protection layer 76 is provided on the surface 72A of the substrate 72 and covers the resistor 74. This protection layer 76 serves as the contact surface 70A of the heater 70. In the heater 70, the sheet P is heated via the heating belt 60 by the heat generated by the resistor 74.

Supporter 80

The supporter 80 shown in FIG. 2 has a function of supporting the heating belt 60. Moreover, the supporter 80 has a function of supporting the heater 70. In detail, the supporter 80 has a support frame 82 and a retaining member 84.

The support frame 82 extends longitudinally in the apparatus depth direction (i.e., the Z direction). When viewed from the apparatus depth direction, the support frame 82 has a U shape in cross section that has an opening facing toward the pressing roller 40. Furthermore, the opposite ends of the support frame 82 in the apparatus depth direction are supported by the device body 50.

The retaining member 84 is, for example, a crystal polymer member extending longitudinally in the apparatus depth direction. Furthermore, the retaining member 84 is attached to a pressing-side section of the support frame 82 and retains the heater 70.

Heat Pipe 90

Figure 4:
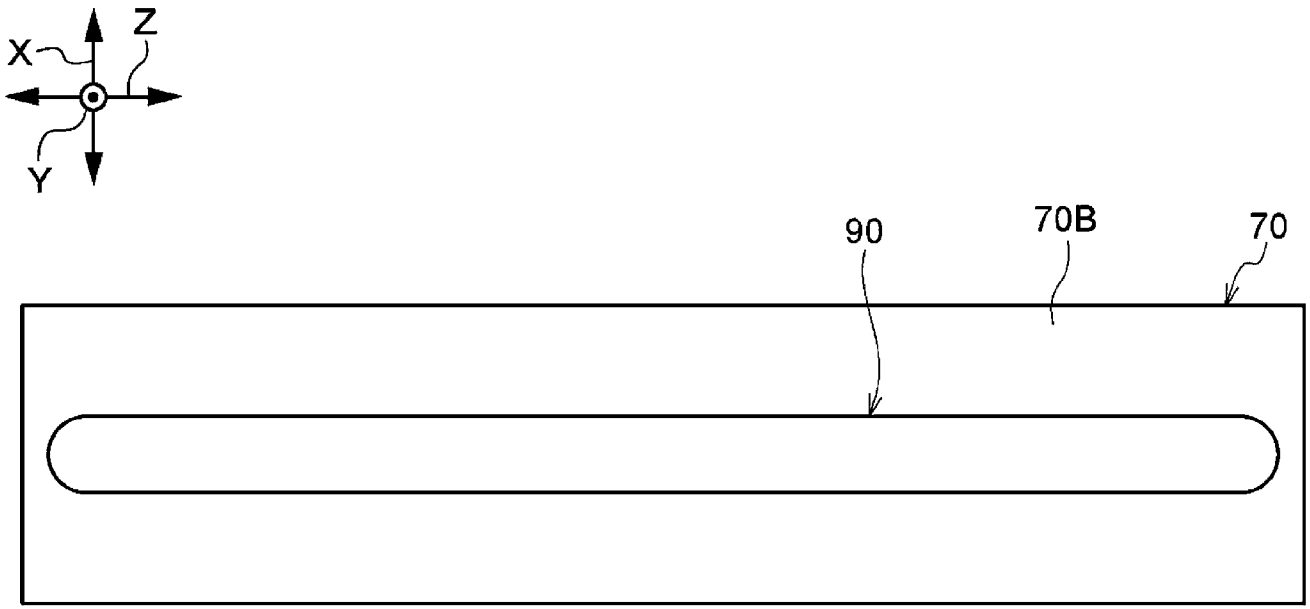
FIG. 4 is a plan view illustrating the configuration of the heater and a heat pipe according to this exemplary embodiment.

As shown in FIG. 2, the heat pipe 90 is a single pipe provided on the non-contact surface 70B of the heater 70. As shown in FIG. 4, the heat pipe 90 extends in the longitudinal direction (i.e., the Z direction) of the heater 70. Specifically, the axial direction of the heat pipe 90 is aligned with the longitudinal direction of the heater 70. Moreover, the heat pipe 90 is disposed at the center of the heater 70 in the lateral direction (i.e., the X direction).

Figure 5:
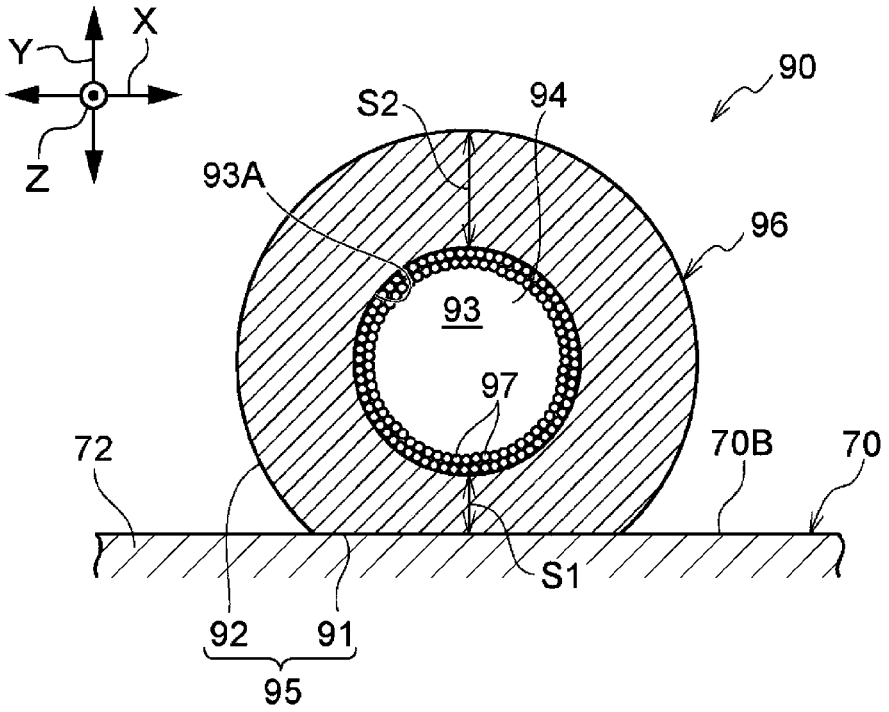
FIG. 5 schematically illustrates the configuration of the heat pipe according to this exemplary embodiment.

As shown in FIG. 5, the heat pipe 90 includes a pipe body 96 having an interior 94 and an outer peripheral surface 95, and also includes wires 97. In FIG. 2, the wires 97 are not shown.

The interior 94 of the heat pipe 90 is provided with a cross-sectionally-circular space 93 filled with a working fluid. The space 93 extends in the axial direction of the heat pipe 90. The space 93 is filled with the working fluid in a state where the space 93 is decompressed.

The outer peripheral surface 95 of the heat pipe 90 includes a flat first outer surface 91 in contact with the non-contact surface 70B of the heater 70, and a second outer surface 92 having a cross-sectionally circular-arc shape extending along a part of a cross-sectionally-circular inner peripheral surface 93A of the space 93. In detail, the second outer surface 92 has a circular arc shape concentric with the inner peripheral surface 93A. Moreover, the second outer surface 92 is not in contact with the non-contact surface 70B of the heater 70. More specifically, the second outer surface 92 is not in contact with other components in the fixing device 30, and is exposed in a space surrounded by the support frame 82 of the supporter 80 (see FIG. 2).

Figure 6:
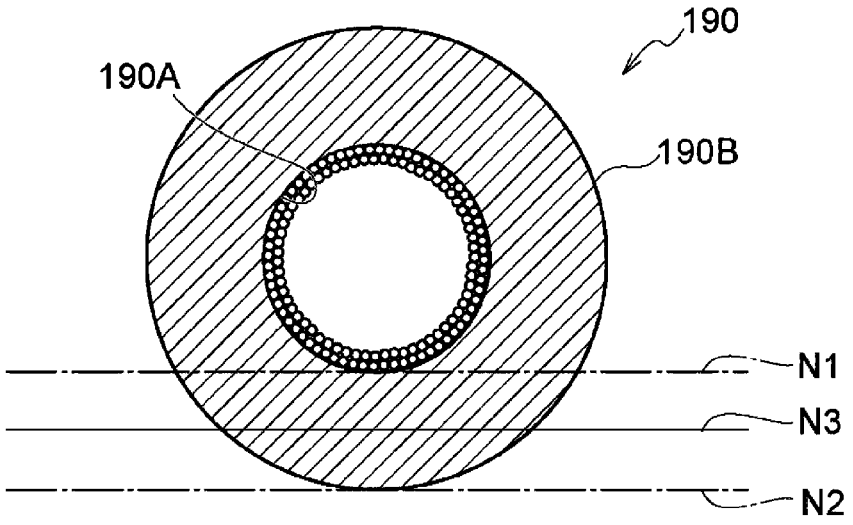
FIG. 6 schematically illustrates a yet-to-be-cut cylindrical body of the heat pipe according to this exemplary embodiment.

In this exemplary embodiment, the first outer surface 91 of the heat pipe 90 is formed by cutting a part of a cylindrical body 190 (see FIG. 6). In detail, as shown in FIG. 6, in a cross-sectional view of the cylindrical body 190 (corresponding to the heat pipe 90 prior to being cut), as viewed from the axial direction thereof, the cylindrical body 190 is cut along a cutting line N3 located between a tangent line N1 and a tangent line N2 and parallel to the tangent lines N1 and N2, so that the heat pipe 90 having the first outer surface 91 is formed. The tangent line N1 is tangent to an inner peripheral surface 190A of the cylindrical body 190. The tangent line N2 is parallel to the tangent line N1 and is tangent to an outer peripheral surface 190B of the cylindrical body 190.

As shown in FIG. 5, in the heat pipe 90, a thickness S1 at the first outer surface 91 is smaller than a thickness S2 at the second outer surface 92. The thicknesses S1 and S2 are thicknesses in the radial direction of the heat pipe 90. Moreover, the heat pipe 90 has an outer radius ranging between, for example, 1 mm and 5 mm inclusive at the second outer surface 92. The dimension at the first outer surface 91 in the lateral direction (i.e., the X direction) of the heater 70 is smaller than or equal to the outer radius.

Figure 7:
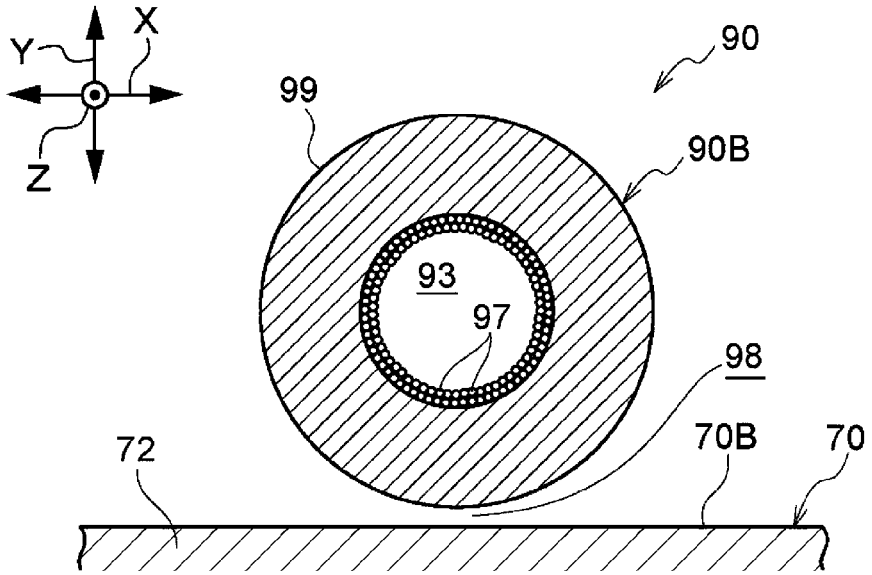
FIG. 7 schematically illustrates the configuration of an axial end of the heat pipe according to this exemplary embodiment.

Furthermore, as shown in FIG. 7, the heat pipe 90 has cylindrical axial ends. In detail, the heat pipe 90 has opposite axial ends 90B that are cylindrical. In other words, the heat pipe 90 has a cross-sectionally-circular outer peripheral surface 99 at each of the opposite axial ends 90B. More specifically, the aforementioned outer peripheral surface 95 is provided in a central part between the opposite axial ends 90B in the axial direction. At each of the opposite axial ends 90B, the heat pipe 90 has a gap 98 relative to the non-contact surface 70B.

The opposite axial ends 90B of the heat pipe 90 have an outer diameter smaller than that of the central part in the axial direction. Furthermore, for example, the opposite axial ends 90B of the heat pipe 90 have an inner diameter that is the same as that of the central part in the axial direction. The opposite axial ends 90B of the heat pipe 90 are closed by being crimped from the cylindrical state.

The wires 97 shown in FIG. 5 are an example of a forming member. The wires 97 are disposed in the space 93 of the heat pipe 90. The wires 97 are a bundle of multiple wires disposed in the space 93 and extending in the axial direction of the heat pipe 90. Consequently, a capillary tube that moves the working fluid in the axial direction is formed. Accordingly, in this exemplary embodiment, a capillary structure (i.e., a so-called wick) is formed by the wires 97.

In detail, the wires 97 are disposed at the non-contact surface 70B side in the space 93 of the heat pipe 90. In other words, the wires 97 are disposed along the inner peripheral surface 93A of the heat pipe 90 at a position opposed to the first outer surface 91. The wires 97 are retained by a retaining member (not shown) in a state where the wires 97 are in contact with the entire inner peripheral surface 93A of the heat pipe 90.

Due to the function of the working fluid enclosed in the interior 94, the heat pipe 90 transfers heat in the belt width direction of the heating belt 60. In detail, the heat of the heater 70 is transferred as follows. The working fluid is boiled by heat applied to the heat pipe 90 by a high temperature section of the heater 70. Vapor of the working fluid generated as a result of the boiling moves to a low temperature section of the heater 70 in accordance with a pressure difference. The vapor condenses at the low temperature section, so that condensation heat is released to the heater 70. Then, the condensed working fluid is returned to the original position (i.e., the high temperature section of the heater 70) in accordance with a capillary phenomenon caused by the capillary tube formed by the wires 97.

Operation According to Exemplary Embodiment

Next, the operation according to this exemplary embodiment will be described.

In the image forming apparatus according to this exemplary embodiment, the image forming unit 16 forms a toner image G onto a sheet P transported by the transport unit 14. In the fixing device 30, the toner image G formed on the sheet P by the image forming unit 16 is pressed by the pressing roller 40 and the heating belt 60 and is heated by the heater 70, so as to become fixed onto the sheet P.

In this exemplary embodiment, when a temperature distribution occurs in the heater 70, the heat pipe 90 transfers heat in the belt width direction of the heating belt 60 from the high temperature section to the low temperature section of the heater 70 in accordance with the function of the working fluid enclosed in the interior 94.

A temperature distribution of the heater 70 occurs when, for example, an image is fixed onto a sheet P having a dimension smaller than that of the heater 70 in the belt width direction. In this case, the heat is surrendered to the sheet P in an area of the heater 70 in the belt width direction, so that a temperature distribution occurs in the heater 70.

The heat pipe 90 has the interior 94 having the cross-sectionally-circular space 93 filled with the working fluid, and also has the flat first outer surface 91 in contact with the non-contact surface 70B of the heater 70.

In a configuration that uses a rectangular heat pipe (referred to as "first configuration" hereinafter), the internal space of the heat pipe is rectangular in cross section, so that pressure occurring from expansion of the working fluid acts lopsidedly on a part of the heat pipe, sometimes causing the heat pipe to break.

In contrast, in the heat pipe 90, the space 93 in the interior 94 of the heat pipe 90 is circular in cross section, so that pressure occurring from expansion of the working fluid may vary less in the circumferential direction, as compared with the first configuration. Therefore, the heat pipe 90 may have improved durability against expansion of the working fluid, as compared with the first configuration.

In a configuration that uses a cylindrical heat pipe (referred to as "second configuration" hereinafter), the outer peripheral surface of the heat pipe is circular in cross section, so that the contact area with the heater 70 tends to be small.

In contrast, in the heat pipe 90, the flat first outer surface 91 is in contact with the non-contact surface 70B of the heater 70, so that a sufficient contact area with the non-contact surface 70B of the heater 70 may be ensured. As a result, heat is efficiently transferred from the high temperature section to the low temperature section of the heater 70, so that temperature variations in the belt width direction of the heating belt 60 may be reduced. Accordingly, fixation variations in the fixing device 30 may be suppressed.

Furthermore, in the heat pipe 90, the second outer surface 92 has a cross-sectionally circular-arc shape extending along a part of the cross-sectionally-circular inner peripheral surface 93A of the space 93. Therefore, the thickness between the second outer surface 92 and the inner peripheral surface 93A may vary less than in a configuration where the second outer surface 92 is polygonal in cross section. More specifically, the second outer surface 92 has a circular-arc shape that is concentric with the inner peripheral surface 93A. Therefore, the thickness between the second outer surface 92 and the inner peripheral surface 93A may vary less than in a configuration where the center of the inner peripheral surface 93A and the center of the second outer surface 92 are not aligned with each other.

Furthermore, in this exemplary embodiment, the first outer surface 91 of the heat pipe 90 is formed by cutting a part of a cylinder. In a configuration where a first outer surface is formed by pressing on a part of the outer periphery of a cylindrical heat pipe (referred to as "third configuration" hereinafter), the heat pipe may sometimes recover its cylindrical shape due to expansion pressure of the working fluid.

In contrast, in the heat pipe 90 according to this exemplary embodiment, the first outer surface 91 is formed by cutting a part of a cylinder, so that deformation of the heat pipe 90 into a cylindrical shape due to expansion pressure of the working fluid may be suppressed, as compared with the third configuration.

Furthermore, in the heat pipe 90 according to this exemplary embodiment, the thickness S1 at the first outer surface 91 is smaller than the thickness S2 at the second outer surface 92. Therefore, as compared with a configuration where the thickness S1 at the first outer surface 91 is equal to the thickness S2 at the second outer surface 92, heat is efficiently transferred from the high temperature section to the low temperature section of the heater 70, so that temperature variations in the belt width direction of the heating belt 60 may be reduced.

Furthermore, in this exemplary embodiment, the heat pipe 90 has the gap 98 relative to the non-contact surface 70B of the heater 70 at each of the opposite axial ends 90B. Therefore, the working fluid may less likely to expand at the opposite axial ends 90B of the heat pipe 90, as compared with a configuration where the opposite axial ends 90B of the heat pipe 90 are in contact with the non-contact surface 70B of the heater 70. Accordingly, an increase in internal pressure may be suppressed at the opposite axial ends 90B of the heat pipe 90, whereby damage to the opposite axial ends 90B may be suppressed.

Furthermore, in this exemplary embodiment, the opposite axial ends 90B of the heat pipe 90 are cylindrical, as shown in FIG. 7. Therefore, even if the opposite axial ends 90B come into contact with the non-contact surface 70B of the heater 70 due to, for example, vibrations, the contact area between the opposite axial ends 90B and the non-contact surface 70B may be reduced, as compared with a configuration where the non-contact surface 70B side of each of the opposite axial ends 90B of the heat pipe 90 is flat.

In the heat pipe 90 according to this exemplary embodiment, the wires 97 are disposed at the non-contact surface 70B side in the space 93 of the heat pipe 90, as shown in FIG. 5. Therefore, heat is efficiently transferred from the high temperature section to the low temperature section of the heater 70, so that temperature variations in the belt width direction of the heating belt 60 may be reduced, as compared with a configuration where the wires 97 are disposed opposite the non-contact surface 70B side in the space 93.

Modifications

As an alternative to this exemplary embodiment in which the wires 97 are used as an example of a forming member, for example, a mesh member may be used as an example of a forming member, so long as the member forms a capillary tube.

As an alternative to this exemplary embodiment in which a single heat pipe 90 is provided in the heater 70, multiple heat pipes 90 may be provided in the heater 70.

As an alternative to this exemplary embodiment in which the second outer surface 92 of the heat pipe 90 has a cross-sectionally circular-arc shape extending along a part of the cross-sectionally-circular inner peripheral surface 93A of the space 93, for example, the second outer surface 92 may be elliptical or polygonal in a cross-sectional view from the axial direction. Moreover, for example, the second outer surface 92 may be partially flat.

Furthermore, as an alternative to this exemplary embodiment in which the second outer surface 92 has a circular-arc shape that is concentric with the inner peripheral surface 93A, for example, the center of the inner peripheral surface 93A and the center of the second outer surface 92 may be offset from each other.

As an alternative to this exemplary embodiment in which the first outer surface 91 of the heat pipe 90 is formed by cutting a part of a cylinder, for example, the first outer surface 91 may be formed by pressing on a part of the outer periphery of a cylindrical heat pipe.

As an alternative to this exemplary embodiment in which the thickness S1 at the first outer surface 91 of the heat pipe 90 is smaller than the thickness S2 at the second outer surface 92 of the heat pipe 90, for example, the thickness S1 at the first outer surface 91 may be equal to the thickness S2 at the second outer surface 92.

As an alternative to this exemplary embodiment in which the heat pipe 90 has the gap 98 relative to the non-contact surface 70B of the heater 70 at each of the opposite axial ends 90B, for example, the opposite axial ends 90B of the heat pipe 90 may be in contact with the non-contact surface 70B of the heater 70.

As an alternative to this exemplary embodiment in which the heat pipe 90 is cylindrical at the opposite axial ends 90B, as shown in FIG. 7, for example, the non-contact surface 70B side of each of the opposite axial ends 90B of the heat pipe 90 may be flat.

The present disclosure is not limited to the above-described exemplary embodiment and permits various modifications, alterations, and improvements within the scope of the disclosure. For example, multiple modifications of the modifications described above may be combined, where appropriate.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The exemplary embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A heating device comprising:

a rotating unit that rotates;

a transport belt that rotates together with the rotating unit while nipping a heated member together with the rotating unit so as to transport the heated member;

a heater that has a contact surface in contact with an inner peripheral surface of the transport belt and a flat non-contact surface not in contact with the inner peripheral surface, and that generates heat so as to heat the heated member via the transport belt; and a heat pipe that has a flat outer surface in contact with the non-contact surface of the heater and an interior having a cross-sectionally-circular space filled with a working fluid, and that transfers heat in a belt width direction of the transport belt in accordance with a function of the working fluid.

2. The heating device according to claim 1, wherein the heat pipe has an outer peripheral surface including a first outer surface as the outer surface, and a second outer surface having a cross-sectionally circular-arc shape extending along a part of a cross-sectionally-circular inner peripheral surface of the space.

3. The heating device according to claim 2, wherein the second outer surface of the heat pipe has a circular-arc shape that is concentric with the cross-sectionally-circular inner peripheral surface of the space.

4. The heating device according to claim 2, wherein the first outer surface of the heat pipe is formed by cutting a part of a cylindrical body.

5. The heating device according to claim 3, wherein the first outer surface of the heat pipe is formed by cutting a part of a cylindrical body.

6. The heating device according to claim 2, wherein, in the heat pipe, a thickness at the first outer surface is smaller than a thickness at the second outer surface.

7. The heating device according to claim 3, wherein, in the heat pipe, a thickness at the first outer surface is smaller than a thickness at the second outer surface.

8. The heating device according to claim 1, wherein the heat pipe has an axial end that is cylindrical.

9. The heating device according to claim 2, wherein the heat pipe has an axial end that is cylindrical.

10. The heating device according to claim 3, wherein the heat pipe has an axial end that is cylindrical.

11. The heating device according to claim 4, wherein the heat pipe has an axial end that is cylindrical.

12. The heating device according to claim 5, wherein the heat pipe has an axial end that is cylindrical.

13. The heating device according to claim 6, wherein the heat pipe has an axial end that is cylindrical.

14. The heating device according to claim 7, wherein the heat pipe has an axial end that is cylindrical.

15. The heating device according to claim 1, wherein the heat pipe has a forming member disposed at a non-contact-surface side in the space and forming a capillary tube that causes the working fluid to move in an axial direction.

16. The heating device according to claim 2, wherein the heat pipe has a forming member disposed at a non-contact-surface side in the space and forming a capillary tube that causes the working fluid to move in an axial direction.

17. The heating device according to claim 3, wherein the heat pipe has a forming member disposed at a non-contact-surface side in the space and forming a capillary tube that causes the working fluid to move in an axial direction.

18. The heating device according to claim 4, wherein the heat pipe has a forming member disposed at a non-contact-surface side in the space and forming a capillary tube that causes the working fluid to move in an axial direction.

19. An image forming apparatus comprising:

an image forming unit that forms an image onto a recording medium; and the heating device according to claim 1 that fixes the image onto the recording medium by heating.

* * * * *